US006128874A

United States Patent [19]

Olson et al.

[11] Patent Number: 6,128,874

[45] Date of Patent: Oct. 10, 2000

[54] FIRE RESISTANT BARRIER FOR DYNAMIC EXPANSION JOINTS

[75] Inventors: James R. Olson, Youngstown, N.Y.; Roger W. Barr, Williamsport, Pa.; Lee A. Peekstok, Sanborn, N.Y.

[73] Assignees: Unifrax Corporation, Niagara Falls, N.Y.; Construction Specialties, Inc., Lebanon, N.J.

[21] Appl. No.: 09/277,589

[22] Filed: Mar. 26, 1999

[51] Int. Cl.[7] ..... E04B 1/682

[52] U.S. Cl. ..... 52/232; 52/396.01; 52/396.04

[58] Field of Search ..... 52/232, 396.01, 52/396.04

[56] References Cited

U.S. PATENT DOCUMENTS

| | | |
|---|---|---|
| D. 279,409 | 6/1985 | Allen, Jr. . |
| D. 293,935 | 1/1988 | Allen, Jr. . |
| D. 299,171 | 12/1988 | Allen, Jr. . |
| 3,458,329 | 7/1969 | Owens et al. . |
| 3,849,958 | 11/1974 | Balzer et al. . |
| 3,916,057 | 10/1975 | Hatch et al. . |
| 4,173,668 | 11/1979 | Hentzelt et al. . |
| 4,184,298 | 1/1980 | Balzer et al. . |
| 4,265,953 | 5/1981 | Close . |
| 4,305,992 | 12/1981 | Langer et al. . |
| 4,363,199 | 12/1982 | Kucheria et al. . |
| 4,364,210 | 12/1982 | Fleming et al. . |
| 4,419,535 | 12/1983 | O'Hara . |
| 4,467,577 | 8/1984 | Licht . |

(List continued on next page.)

FOREIGN PATENT DOCUMENTS

0501271 A2 2/1992 European Pat. Off. .

OTHER PUBLICATIONS

UL 2079 Standard for "Tests for Fire Resistance of Building Joint Systems", Third Edition, Jul. 31, 1998.

UL 2079 Standard for "Tests for Fire Resistance of Building Joint Systems", First Edition, Nov. 29, 1994.

UL Directory, Fire Resistance, vol. 2, 1999 pp. i–ii, 1025, 1031, 1038–1040, 1042–1044, 1135–1136, 1144–1446 & 2307.

Construction Specialties Expansion Joint Cover Product Catalog, 1998, pp. 6–7.

Construction Specialties Expansion Joint Cover Product Catalog, 1999, pp. 4–5, 11, 13, 15, 17 & 19.

MM Systems Seismic and Expansion Control Joint System Product Catalog, 1998, pp. 20–24.

Balco Inc. Fire Related Joint Covers Catalog, pp. 3–5.

Thermal Structures Inc. Fire Barrier Systems for Thermal, Wind Sway and Seismic Environments, Product Catalog, pp. 2–3.

Architectural Art Mgf., Inc., Expansion Joint Cover Systems Product Catalog, Jan. 1999, pp. 20–21.

*Primary Examiner*—Christopher T. Kent
*Attorney, Agent, or Firm*—Renner, Kenner, Greive, Bobak, Taylor & Weber

[57] ABSTRACT

A fire resistant barrier and system for dynamic building expansion joints comprising a plurality of layers of fire resistant material comprising: a first mechanical support layer having a first and second major surface; a second layer having a first and second major surface, wherein the second layer provides protection and mechanical support to the fire barrier; and at least one layer of intumescent sheet material having a first and second major surface; said at least one layer of intumescent material is disposed between said first mechanical support layer and said second layer; and wherein said first mechanical support layer, said second layer and said at least one layer of intumescent material are locally bonded together over only a portion of their width substantially continuously along the length of the layers of said fire resistant material. The fire barrier is secured to concrete building members with retainer angle brackets and does not require the use of conventional caulking materials to effect a tight seal between the building structure and the fire barrier.

46 Claims, 1 Drawing Sheet

U.S. PATENT DOCUMENTS

| | | | |
|---|---|---|---|
| 4,509,559 | 4/1985 | Cheetham et al. . | |
| 4,566,242 | 1/1986 | Dunsworth . | |
| 4,766,420 | 8/1988 | Hastings et al. . | |
| 4,811,529 | 3/1989 | Harris et al. . | |
| 4,894,966 | 1/1990 | Bailey et al. . | |
| 4,931,339 | 6/1990 | Malcolm-Brown . | |
| 4,942,710 | 7/1990 | Rumsey . | |
| 4,952,615 | 8/1990 | Welna . | |
| 4,967,527 | 11/1990 | Gohlke . | |
| 4,977,719 | 12/1990 | LaRoche . | |
| 4,999,962 | 3/1991 | Gohlke et al. . | |
| 5,032,447 | 7/1991 | Bailey . | |
| 5,048,249 | 9/1991 | Shreiner et al. . | |
| 5,060,439 | 10/1991 | Clements et al. . | |
| 5,103,609 | 4/1992 | Thoreson et al. . | |
| 5,140,797 | 8/1992 | Gohlke et al. . | |
| 5,145,811 | 9/1992 | Lintz et al. . | |
| 5,147,710 | 9/1992 | Bopp et al. . | |
| 5,187,910 | 2/1993 | Nicholas et al. . | |
| 5,215,806 | 6/1993 | Bailey . | |
| 5,252,005 | 10/1993 | Koos . | |
| 5,263,293 | 11/1993 | Gohlke et al. . | |
| 5,269,110 | 12/1993 | Morrison et al. | 52/396.02 X |
| 5,279,087 | 1/1994 | Mann . | |
| 5,326,609 | 7/1994 | Gohlke . | |
| 5,351,448 | 10/1994 | Gohlke et al. . | |
| 5,384,188 | 1/1995 | Lebold et al. . | |
| 5,398,467 | 3/1995 | Ricq et al. . | |
| 5,402,615 | 4/1995 | Knott et al. . | |
| 5,427,386 | 6/1995 | Breaker . | |
| 5,442,884 | 8/1995 | Nicholas . | |
| 5,456,050 | 10/1995 | Ward . | |
| 5,458,966 | 10/1995 | Matsumoto et al. . | |
| 5,461,838 | 10/1995 | Heller . | |
| 5,502,937 | 4/1996 | Wilson . | |
| 5,681,640 | 10/1997 | Kiser . | |
| 5,765,332 | 6/1998 | Landin et al. . | |
| 5,875,598 | 3/1999 | Batten et al. | 52/396.02 X |

FIRE RESISTANT BARRIER FOR DYNAMIC EXPANSION JOINTS

TECHNICAL FIELD OF THE INVENTION

The present invention is directed to a fire resistant barrier for use in building structures. The present invention is more particularly directed to a fire resistant barrier for use in conjunction with dynamic wall, ceiling and floor expansion joints to prevent the communication of fire and smoke under the conditions of a fire in buildings having these types of expansion joints.

BACKGROUND OF THE INVENTION

Architects and engineers must take into account the effects not only of seismic movement, but also movements caused by building sway, settlement, thermal expansion and contraction. Architects know that any building that may be subjected to ground oscillations must be designed to control and accommodate movement caused by resonation within the structure while additionally providing for tower sway, thermal movement and settlement.

To overcome the problems associated with building movement, architects have designed buildings with various dynamic expansion joints between the walls, ceilings and floors to take into account the sway, ground motion, and settlement associated with buildings. Dynamic expansion joints are linear openings in a building designed to allow for building movement.

A disadvantage of the use of expansion joints is that they create a chimney effect in the building structure, under the conditions of a fire. Chimney effect refers to the tendency of fire and smoke to communicate through a vertical passage during a fire. Because fire is an ever-present danger in association with any building and the chimney effect at unprotected expansion joints may actually advance the communication of fire and smoke to other parts of a building, it is highly desirable to utilize a fire barrier in conjunction with any expansion joint assembly to provide additional protection to aid in the prevention of the spreading of any fire.

Fire resistant barriers have been developed that comprise layers of a suitable fire retardant material reinforced with wire mesh and/or foils. This metal reinforcement is positioned between the expansion joint and the fire resistant barrier prior to the application of the expansion joint assembly. The fire barrier is a highly thermal resistant material which protects the joint from the associated chimney effect within the building construction.

Fire barrier devices have also been designed that comprise flexible, composite barriers including a laminate of intumescent material and a backing material, such as metal foils or sheets, paper, plastic, cloth, or a mat of inorganic fibers in a binder. When exposed to heat or fire, the intumescent materials expand so as the fill open spaces in the vicinity of the architectural joint to prevent the passage of smoke, fire, water or gas.

Prior to the development of Underwriters Laboratories' test number 2079 (UL 2079) for the testing of fire resistance of building joint systems, cycling of the fire barriers before the testing of fire resistance of a fire barrier in building expansion joint applications was not required. UL test number 2079 was developed to include a cycling requirement prior to testing a building joint expansion system for fire resistance. According to the prior version of UL 2079, each building expansion joint system was required to be conditioned by subjecting the joint system to a minimum of twenty complete movement cycles to provide a condition representative of expansion joints in building structures, prior to testing for fire resistance. The conditioning requirement of UL 2079 has recently been changed to require that each building expansion joint system be conditioned for a minimum of five hundred complete movement cycles prior to testing for fire resistance.

Other prior art expansion joint treatment systems have included insulated metal foil (e.g. aluminum) layers such as those disclosed in the Fire Resistance Directory, published by Underwriter's Laboratories. Although many prior art fire barriers imply the capability to move within an expansion joint in response to normal and seismic building movement, heretofore, no prior art expansion joint fire barrier system has passed both the cycling requirement and fire resistance requirement of the new version of UL 2079. While these fire resistant barrier layers are suitable for reduction in the chimney effect associated with buildings containing expansion joints, they clearly can be improved.

LaRoche et al., U.S. Pat. No. 4,977,719, discloses a fire resistant expansion joint comprising a fire barrier comprised of a flexible fire resistant inorganic refractory fiber fabric sheet which supports resilient fire resistant inorganic refractory fibers. The flexible fire resistant inorganic refractory fiber fabric sheet is curved across its width to accommodate movement of the spaced building members.

Wilson et al., U.S. Pat. No. 5,502,937 discloses a fire protective flexible composite insulating system for either static or dynamic joints comprising a first layer material having a first and second major surface, the first layer material including inorganic fibers and a binder in the form of a flexible mat; a second layer material adhered to the first major surface of the first layer material, the second layer material consisting essentially of metal foil, and a third layer adhered to the second major surface of the first material, the third layer material including an intumescent fire retardant composite material. In a preferred embodiment, the composite insulating system comprises an insulating component, a safing component and a fire barrier component comprising a flexible composite material having a first and second portion, wherein the second portion has at least one curved portion which provides slack, thus allowing the fire barrier to effectively lengthen and shorten during relative movement of the building structure.

Landin et al., U.S. Pat. No. 5,765,332, discloses a fire barrier protected dynamic joint comprising a flexible sheet of fire barrier material and an adhesive for bonding the sheet to an attachment area of the joint. The weight of the flexible sheet of fire barrier material causes the middle region of said flexible sheet to sag within the expansion joint, providing slack for the outward expansion of the joint.

Although the above mentioned prior art fire barriers are designed to allow for relative expansion and movement of the building structure, none disclose the fire barrier and system of the present invention. Thus, there is a great need in the art of fire resistance and thermal insulation to provide a fire resistant barrier system for building expansion joints which provides adequate fire resistance under static and dynamic conditions, and which retains resiliency during normal and seismic building cycling and movement.

SUMMARY OF THE INVENTION

It is therefore an object of the present invention to provide a fire resistant barrier and system for dynamic expansion joints.

It is another object of the present invention to provide a fire resistant barrier and system for dynamic expansion joints in which the layers of the fire resistant barrier permit horizontal cyclical movement during mechanical cycling of a building structure.

It is another object of the present invention to provide a fire resistant barrier and system for dynamic expansion joints that provides effective thermal insulation performance.

It is another object of the present invention to provide a fire resistant barrier and system for dynamic expansion joints that retains resiliency in response to normal and seismic building cycling and movement.

These and other objects of the present invention are accomplished by the fire barrier and method of installation which is hereafter described and claimed. The objects and advantages of the invention may be realized and attained by means of the embodiments and combinations particularly pointed out in the attached claims.

The present invention, therefore, provides a fire resistant barrier for dynamic building expansion joints comprising a plurality of layers of fire resistant material comprising: a first mechanical support layer having a first and second major surface; a second layer having a first and second major surface, wherein said second layer provides protection and mechanical support to said fire barrier; and at least one layer of intumescent sheet material having a first and second major surface; said at least one layer of intumescent material is disposed between said first mechanical support layer and said second layer; and wherein said plurality of layers of fire resistant material comprising said fire resistant barrier are locally bonded together over only a portion of their width substantially continuously along the length of said layers.

The present invention further provides a fire resistant barrier system comprising a fire resistant barrier and at least one radiation heat shield, said fire resistant barrier comprises a plurality of layers of fire resistant material comprising: a first mechanical support layer having a first and second major surface; a second layer having a first and second major surface, wherein said second layer provides protection and mechanical support to said fire barrier; and at least one layer of intumescent sheet material having a first and second major surface; said at least one layer of intumescent material is disposed between said first mechanical support layer and said second layer; and wherein said plurality of layers of fire resistant material comprising said fire resistant barrier are locally bonded together over only a portion of their width substantially continuously along the length of said layers; wherein said at least one radiation shield comprises at plurality of layers of fire resistant material comprising at least one layer of inorganic fibrous mat material having a first and second major surface encapsulated by two layers of metalized, inorganic fiber reinforced polymeric material; and wherein said radiation heat shield is adapted to be installed in the space above said fire resistant barrier, within a dynamic building expansion joint.

The present invention further provides a method of installing the fire resistant barrier to a building structure comprising providing a fire resistant barrier having a plurality of layers of fire resistant material comprising: a first mechanical support layer having a first and second major surface; a second layer having a first and second major surface, wherein said second layer provides protection and mechanical support to said fire barrier; and at least one layer of intumescent sheet material having a first and second major surface; said at least one layer of intumescent material is disposed between said first mechanical support layer and said second layer; and wherein said plurality of layers of fire resistant material comprising said fire resistant barrier are locally bonded together over only a portion of their width substantially continuously along the length of the fire resistant material layers; and attaching the fire resistant barrier to a building member with retainer angle brackets.

In another embodiment of the present invention, the fire barrier system further comprises an expansion joint cover plate to provide a bridge across the expansion joint and to provide added fire resistance.

DETAILED DESCRIPTION OF THE INVENTION

Figure 1:
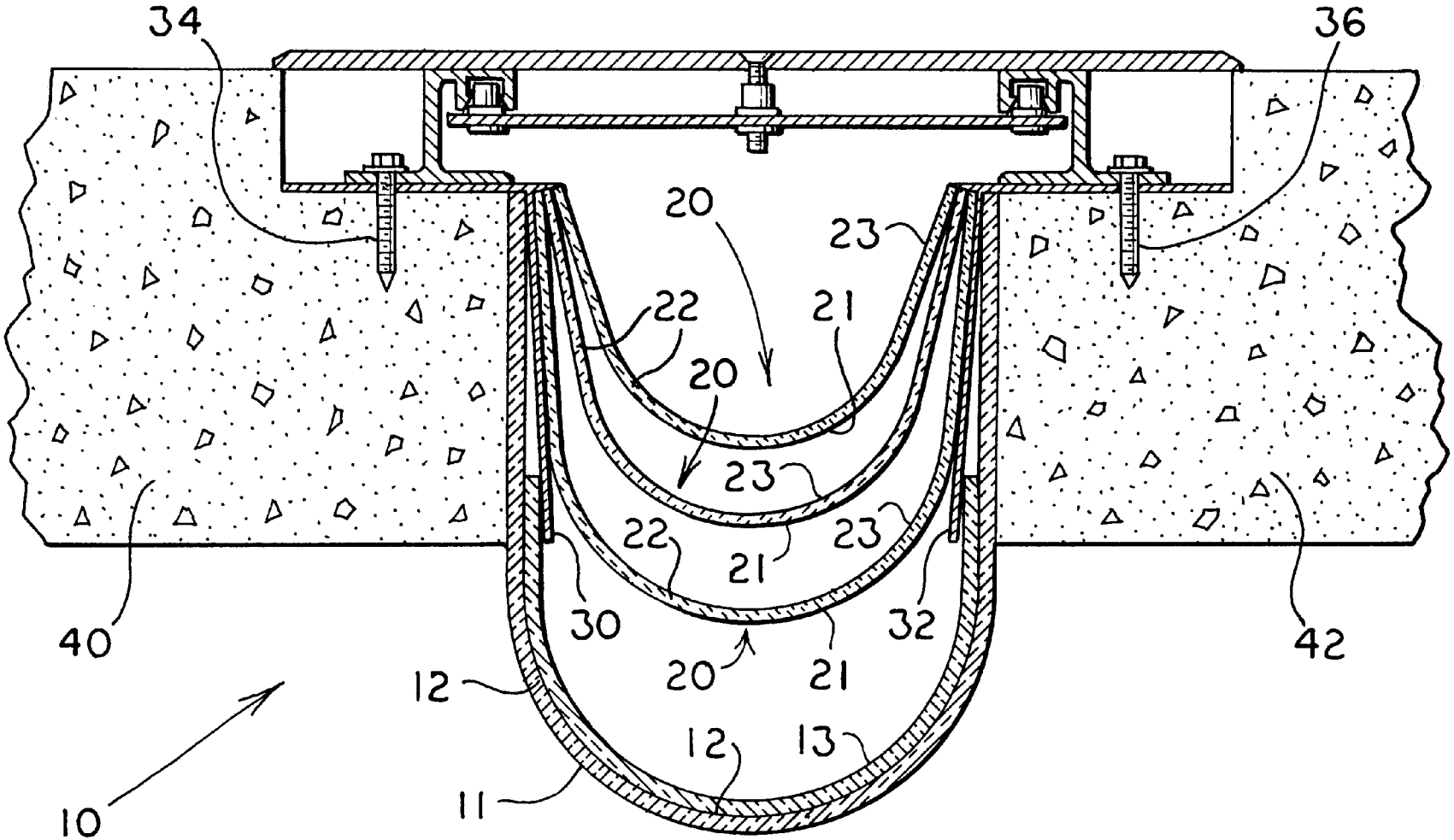
FIG. 1 is a schematic representation of the fire barrier system embodiment of the present invention comprising a fire barrier and a plurality of radiation heat shields.

To overcome the disadvantages of the fire resistant barriers for expansion joints disclosed in the prior art, the present invention provides a fire resistant barrier and system for building expansion joints, which provides fire resistance and maintains its resiliency during both normal and seismic building cycling or movement.

With reference to FIG. 1, the present invention provides a fire resistant barrier 10 for dynamic building expansion joints comprising a plurality of layers 11–13 of fire resistant material comprising a first mechanical support layer 11 having a first and second major surface; a second layer 13; and at least one layer of intumescent sheet material 12 having a first and second major surface. The layer of intumescent sheet material 12 is disposed between said first mechanical support 11 and said second layer 13. The second layer 13 provides protection and mechanical support to the fire barrier and may be comprised of a polymeric material, a fiber reinforced polymeric material, a metalized, fiber reinforced polymeric material or a metalized, fiberglass cloth. A metalized, fiber reinforced polymeric material, such as aluminized, glass fiber reinforced polypropylene is the preferred material for the second layer of the fire barrier. According to the present invention, the plurality of layers of fire resistant material comprising said fire resistant barrier are locally bonded together over only a narrow portion of their width substantially continuously along the entire length of their surfaces.

The plurality of layers of fire resistant material 11–13 are, therefore, bonded together in a manner that allow horizontal cyclical movement during normal and seismic mechanical cycling of the building, without producing internal stress within the plurality of layers of fire resistant material which could result in the breakage of the bond between the layers. Suitable methods for bonding the plurality of fire resistant layers together include stitching, stapling, tacking, riveting and using an adhesive material. The most preferred method for bonding the plurality of fire resistant layers together is the use of an adhesive material.

Although FIG. 1 shows the layers of the fire barrier against substantially the entire portion of their surfaces, the layers are locally bonded together over only a narrow portion of their width substantially continuously along entire length of their surfaces. This construction permits the layers of fire resistant material to shift relative to each other without breaking, tearing or failure of the fire barrier when exposed to thermal cycling or physical movement or sway of the building structure.

The bonding of the plurality of layers of fire resistant material is accomplished by using a narrow layer of adhesive between each layer of fire resistant material. Preferably, the bonding of the plurality of layers of fire resistant material is accomplished by using a narrow layer of adhesive between along the longitudinal center between each layer only. The narrow adhesive bond keeps all the fire resistant material layers bonded together and permits horizontal and cyclical movement of the layers in response to normal and seismic building movement or thermal cycling.

As described above, the fire barrier of the present invention comprises a flexible mechanical support layer. The flexible mechanical support layer provides the primary structural and mechanical support for the entire mass of the fire barrier of the present invention. Suitable materials that may comprise the flexible mechanical support layer include, but are not limited to stainless steel, aluminum, copper, and high temperature resistant woven textiles. The preferred material comprising the flexible mechanical support layer is a layer of stainless steel. Examples of high temperature resistant woven textiles include high silica cloth, or woven ceramic fibers, sold by Unifrax Corporation under the tradename FIBERFRAX.

The mechanical support layer may be a structure in the form of a sheet, foil, mesh, screen or high temperature resistant woven textile. Preferably, the mechanical support layer is provided in the form of a metal foil, such as stainless steel foil.

The second layer of the fire barrier of the present invention comprises a layer of material that provides protection and mechanical or structural support to the fire barrier. The second layer may comprise a polymeric material, a fiber reinforced polymeric material or a metalized, fiber reinforced polymeric material. Suitable polymers that may comprise the polymeric material of the second layer of the fire barrier include, but are not limited to polypropylene, polyethylene, polyester thermoplastic elastomers and thermoplastic rubbers. The preferred polymer comprising polymeric material comprising this layer is polypropylene. The preferred material comprising the second layer of the fire barrier is a metalized, fiber reinforced polymeric material, such as aluminized, glass fiber reinforced polypropylene. In an alternative configuration, the layer of metalized, fiber reinforced polymeric material may be substituted with metalized fiberglass cloth, such as aluminized fiberglass cloth.

Suitable materials that may be included in the metalized, fiber reinforced polymeric material layer include, but are not limited to inorganic fibers, such as glass, silica, ceramic fibers, polymeric fibers, such as aramid fibers, and metal wire. The ceramic fibers are preferably in the form of continuous ceramic filaments. The preferred fibers that may comprise the metalized, fiber reinforced polymeric material layer are glass fibers. The preferred aramid fibers are Kevlar™ fibers. The metal wire may be selected from the group consisting of steel and aluminum wire.

The metalized, fiber reinforced polymeric material layer may be provided in the form of a sheet, paper, felt, fabric, blanket, film or foil. The metalized, inorganic fiber reinforced polymeric material layer is preferably in the form of a foil.

The intumescent sheet material used in the fire resistant barrier 10 may comprise an intumescent material mat paper, sheet, felt or blanket produced from unexpanded vermiculite, hydrobiotite, or water-swelling tetrasilicic flourine mica using organic or inorganic binders to provide a desirable degree of strength. The sheet material can be produced by standard paper-making techniques as described, for example, in U.S. Pat. No. 3,458,329, the disclosure of which is incorporated by reference. Examples of suitable intumescent sheet materials are disclosed in U. S. Pat. Nos. 3,916,057 and 4,305,992, the disclosures of which are incorporated by reference.

Alternatively, the intumescent material may comprise a mixture of unexpanded vermiculite and expandable graphite in a relative amount of about 9:1 to about 1:2 vermiculite:graphite, as described in U.S. Pat. No. 5,384,188, the disclosure of which is incorporated by reference.

Preferably, the intumescent material comprises a composite blend of fibers, wherein the fibers are selected from refractory ceramic fibers and high temperature resistant glass fibers, unexpanded vermiculite, and an organic binder system. Such a material, including Fiberfrax™ alumina-silica ceramic fibers, is available from Unifrax Corporation (Niagara Falls, NY) under the XFP Expanding Fyre Paper trademark. The high temperature resistant ceramic fibers in the intumescent mat allow the fire resistant barrier to withstand temperatures up to 2300° F. A representative formulation for such a preferred intumescent fire barrier material includes about 30 to about 45 weight percent high temperature resistant fibers (preferably alumina-silica), about 45 to about 60 weight percent unexpanded vermiculite, and about 5 to about 10 weight percent organic binder.

The intumescent material layer of the fire resistant barrier of the present invention expands up to three times its thickness when exposed to temperatures above 620° F. Under the conditions of a fire, the intumescent material expands to fill joints and voids to prevent the spread of flames, heat and smoke through the barrier-joint edge area, to other parts of the building structure.

The adhesive which is applied to the plurality of fire resistant material comprising the fire resistant barrier of the present invention may comprise a pressure sensitive rubber based adhesive, double coated films, or a variety of rubber based hot melt adhesives. The adhesive may be applied to the plurality of fire resistant layers during manufacturing or during installation. When the adhesive is applied during manufacturing of the fire barrier, a release layer may be employed to protect the adhesive. The release layer may be carried on a film, including paper, or a themoplastic or thermoset polymeric film.

In another embodiment, the present invention provides a fire resistant barrier system comprising a fire resistant barrier 10 and at least one thin radiation heat shield 20. The fire resistant barrier 10 includes a plurality of layers of fire resistant material 11–13 comprising a first mechanical support layer 11 having a first and second major surface; a second layer 13 having a first and second major surface, wherein said second layer provides protection and mechanical support to said fire barrier; and at least one layer of intumescent sheet material 12 having a first and second major surface. The layer of intumescent sheet material 12 is disposed between the first mechanical support layer 11 and the second layer 13. The first mechanical support layer 11, the second layer 13 and at least one layer of intumescent sheet material 12 comprising the fire resistant barrier 10 are locally bonded together over only a portion of their width substantially continuously along the length of said layers of fire resistant material, preferably with a narrow layer of adhesive material along the longitudinal center. The plurality of fire resistant material layers may also be bonded together using tape, tacks, staples or rivets.

The radiation heat shields 20 preferably comprises a plurality of layers of fire resistant material 21–23 comprising at least one layer of inorganic fibrous mat material 22 having a first and second major surface encapsulated by two layers of metalized, inorganic fiber reinforced polymeric material 21, 23. The radiation heat shields 20 are adapted to be installed in the space above the fire resistant barrier, within a dynamic building expansion joint. The thickness of each of the layers of fire resistant material comprising the radiation heat shield is about 1/16 to about ½ inches, but may vary depending on the specific application conditions.

In the fire resistant barrier assembly described hereinabove, the radiation shield preferably contains an inorganic fibrous mat material or paper layer. The inorganic fibrous mat material or paper layer may comprise alumina-silica glassy fiber and shot, together with an organic binder. A preferred alumina-silica ceramic fiber paper having a 70/30 fiber/shot ratio and containing about 7 weight percent organic binder is available under the tradename Fiberfrax™ paper from Unifrax Corporation (Niagara Falls, N.Y.), as well as a higher temperature resistant ceramic fiber paper produced from Fibermax™ polycrystalline mullite ceramic fibers. Other suitable refractory papers useful in the present invention comprise heat resistant Insulfrax™ and Isofrax™ glass fibers, also available from Unifrax Corporation, or fiberglass, such as E glass and S2 glass.

The present invention further provides a method of installing the fire resistant barrier 10 to building structure members 40, 42 comprising providing a fire resistant barrier 10 having a plurality of layers of fire resistant material 11–13 comprising a first mechanical support layer 11 having a first and second major surface; a second layer 13 having a first and second major surface, wherein said second layer provides protection and mechanical support to said fire barrier; and at least one layer of intumescent sheet material 12 having a first and second major surface. As described above, the layer of intumescent sheet material 12 is disposed between said mechanical support layer 11 and the second layer 13. The first mechanical support layer 11, the second layer 13 and the layer of intumescent sheet material 12 comprising said fire resistant barrier 10 are locally bonded together over only a portion of their width substantially continuously along the entire length of their surfaces. The method further includes attaching the fire resistant barrier 10 to building members 40, 42 with retainer angle brackets 30, 32.

The thermal performance of the fire barrier of the present invention increases as the length of the retainer angle brackets is increased. Thermal performance is improved by increasing the length of the retainer angles up to the thickness of the concrete structure to which it is attached. When the fire barrier is installed in a building expansion joint it is important that the layers of fire resistant material are held tight against the surface of the concrete building members to provide a tight seal between the building member and the fire barrier system, thus preventing the transfer of fire, smoke and hot gas from the area below the fire barrier to the area above the fire barrier system. A tight seal between the fire barrier and the concrete building member is enhanced by anchoring the fire barrier to the concrete building members with angular brackets having an angle bend of about 85 degrees and a leg length that is substantially equal to the thickness of the concrete building member. The design of the fire barrier of the present invention does not require the use of conventional caulking materials to form a tight seal between the fire barrier and the concrete building members.

The fire resistant barrier material layers are not pulled tautly, but contain slack to allow for movement perpendicular to the lengthwise direction of the joints. The fire barrier is preferably mechanically affixed to the structural members. The mechanical attachment may be by means of galvanized angle irons 30, 32 bolted to the building members 40, 42 to form a permanent, immovable attachment, such as with masonry anchors 34, 36, or in some instances, may provide for horizontal cyclical movement within the expansion joint.

In another embodiment of the present invention, the fire barrier may further comprise a expansion joint cover plate to provide a bridge across the expansion joint and to provide additional fire resistance. The materials that may comprise the expansion joint cover plate are selected from the group consisting of galvanized steel, magnesium, stainless steel, bronze, brass and aluminum. The preferred material useful in the present invention is aluminum. The cover plate may be attached to a concrete building structure members by any suitable means such as masonry anchors, screws and power anchors. The cover plate is preferably attached to the concrete building structure members with masonry anchors.

Because of the design of the fire barrier of the present invention, having the layers of fire resistant material locally bonded over only a portion of the width of their surfaces, the fire barrier of the present invention is capable of a horizontal cyclical movement in the range of about ±50–90 percent of the nominal joint opening size. The fire resistant barrier of the present invention therefore accommodates the normal and seismic cycling movement of architectural structures, unlike the fire barriers of the prior art.

GENERAL EXPERIMENTAL

The fire resistance and integrity of the fire resistant barrier of the present invention were evaluated by tests defined by Underwriter's Laboratories Test for Fire Resistance of Building Joint Systems (UL Test Number 2079). Prior to fire testing, the fire barrier was subjected to a minimum of five hundred complete movement cycles to provide a condition representative of expansion joints in building structures.

The fire barrier of the present invention passes both the seismic cycling and fire test criteria of UL Test Number 2079-Test for Fire Resistance of Building Joint Systems. The fire resistant barrier of the present invention provides extreme horizontal cyclical movement and maintains its structural integrity during the normal cycling and movement of building structures. The fire resistant barrier of the present invention is optimized to reduce cost and weight, while still passing both the cycling and fire resistance requirements of UL test number 2079.

The fire resistant barrier of the present invention can be designed in a variety of sizes, each appropriate for a specific joint design or size. The design of the fire resistant barrier of the present invention is optimized for expansion joint having nominal openings ranging from 1 inch to 6 inches. The fire barrier and system of the present invention may be adapted for floor, wall, ceiling, corner wall, floor to wall, floor to corner wall, wall to ceiling and corner wall to ceiling applications. The fire barrier of the present invention may be provided in a roll which allows for greater flexibility of installation and reduces the number of splice joints required.

It is thus demonstrated that the fire resistant barrier of the present invention achieves the objects of the invention. The objects of the invention are accomplished by the fire resistant barrier and method of installation of the present invention, which is not limited to the specific embodiments described above, but which includes variations modifications and equivalent embodiments defined by the following claims.

We claim:

1. A fire resistant barrier for architectural expansion joints comprising a plurality of fire resistant material layers comprising:

a first mechanical support layer having a first and second major surface;

a second layer having a first and second major surface, wherein said second layer provides protection and mechanical support to said fire barrier;

at least one layer of intumescent sheet having a first and second major surface, wherein said at least one layer of intumescent sheet is disposed between said first mechanical support layer and said second layer; and wherein said first mechanical, said second, and said intumescent sheet layers are locally bonded together only substantially along a longitudinal center and substantially continuously along the length of said layers.

2. The fire barrier of claim 1, wherein said second layer comprises one selected from the group consisting of a polymeric material, a fiber reinforced polymeric material a metalized fiber reinforced polymeric material, and a metalized, fiberglass cloth material.

3. The fire barrier of claim 2, wherein said polymeric material is selected from the group consisting of polypropylene, polyethylene, polyester, thermoplastic elastomers and thermoplastic rubbers.

4. The fire barrier of claim 3, wherein said polymeric material is polypropylene.

5. The fire barrier of claim 2, wherein said fibers comprising the metalized, fiber reinforced polymeric material are selected from the group consisting of inorganic fibers and polymeric fibers.

6. The fire barrier of claim 5, wherein said polymeric fibers are aramid fibers.

7. The fire barrier of claim 5, wherein said inorganic fibers are selected from the group consisting of glass, silica and ceramic fibers.

8. The fire barrier of claim 2, wherein said metalized, fiber reinforced polymeric layer is aluminized, glass fiber reinforced polypropylene material.

9. The fire barrier of claim 2, wherein said metalized, fiber reinforced polymeric material layer is a structure selected from the group consisting of a film, foil, sheet, paper, felt, and blanket.

10. The fire barrier of claim 1, wherein said material comprising the mechanical support layer is selected from the group consisting of stainless steel, aluminum, copper and high temperature resistant woven textiles.

11. The fire barrier of claim 1, wherein said mechanical support layer is a structure selected from the group consisting of a sheet, foil, screen, mesh and high temperature resistant woven textiles.

12. The fire resistant barrier of claim 1, wherein said intumescent sheet contains intumescent material selected from the group consisting of unexpanded vermiculite, hydrobiotite, water-swelling tetrasilicic fluorine mica, expandable graphite and mixtures thereof.

13. The fire resistant barrier of claim 1, wherein said intumescent sheet comprises a blend of fibers, wherein said fibers are selected from the group consisting of refractory ceramic fibers and high temperature resistant glass fibers; unexpanded vermiculite; and an organic binder.

14. The fire resistant barrier of claim 13, wherein said intumescent sheet layer comprises a mat containing about 30 to about 45 weight percent refractory ceramic fibers, about 45 to about 60 weight percent unexpanded vermiculite, and about 5 to about 10 weight percent organic binder.

15. The fire resistant barrier of claim 13, wherein said refractory ceramic fiber is selected from the group consisting of alumina-silica, polycrystalline mullite and glass mat materials.

16. The fire resistant barrier of claim 13, wherein said organic binder is an acrylic latex binder.

17. The fire resistant barrier of claim 1, wherein said first mechanical support layer, said second layer and said at least one intumescent sheet layer are locally bonded together by at least one of a bonding means selected from the group consisting of tape, tacks, rivets, stitches, staples and adhesives.

18. The fire resistant barrier of claim 17, wherein said adhesive is selected from the group consisting of pressure sensitive rubber adhesive, double adhesive coated films, hot melt rubber adhesive, hot melt glue and sprayable rubber cement.

19. The fire resistant barrier of claim 1, wherein said barrier is adapted to be attached to a building structure by retainer angle brackets.

20. The fire resistant barrier of claim 19, wherein said material comprising said retainer angle brackets is selected from the group consisting of galvanized steel, stainless steel and aluminum.

21. A fire resistant barrier system comprising a fire resistant barrier and at least one radiation heat shield, wherein said fire resistant barrier comprises a first mechanical support layer having a first and second major surface; a second layer having a first and second major surface, wherein said second layer provides protection and mechanical support to the fire barrier; and at least one layer of intumescent sheet having a first and second major surface, wherein said at least one layer of intumescent sheet is disposed between said first mechanical support layer and said second layer; wherein said first mechanical support layer, said second layer and said at least one layer of intumescent sheet are locally bonded together only substantially along a longitudinal center and substantially continuously along the length of said layers; and wherein said at least one radiation heat shield comprises a plurality of fire resistant material layers comprising at least one layer of inorganic fibrous mat material having a first and second major surface encapsulated by two separate layers of metalized, inorganic fiber reinforced polymeric material.

22. The fire barrier system of claim 21, wherein said second layer comprises one selected from the group consisting of a polymeric material, a fiber reinforced polymeric material a metalized, fiber reinforced polymeric material, and a metalized, fiberglass cloth material.

23. The fire barrier system of claim 22, wherein said polymeric material is selected from the group consisting of polypropylene, polyethylene, polyester, thermoplastic elastomers and thermoplastic rubbers.

24. The fire barrier system of claim 23, wherein the polymeric material is polypropylene.

25. The fire barrier system of claim 22, said fibers comprising the metalized, fiber reinforced polymeric material are selected from the group consisting of inorganic fibers and polymeric fibers.

26. The fire barrier system of claim 25, wherein said polymeric fibers are aramid fibers.

27. The fire barrier system of claim 25, wherein said inorganic fibers are selected from the group consisting of glass, silica and ceramic fibers.

28. The fire barrier system of claim 22, wherein the metalized, fiber reinforced polymeric layer is aluminized, glass fiber reinforced polypropylene material.

29. The fire barrier system of claim 23, wherein said at least one radiation heat shield is adapted to be installed in the space above the fire barrier, within a dynamic building expansion joint.

30. The fire barrier system of claim 22, wherein said metalized, fiber reinforced polymeric material layer is a structure selected from the group consisting of a film, foil, sheet, paper, felt and blanket.

31. The fire barrier system of claim 21, wherein said mechanical support layer is a structure selected from the group consisting of a sheet, foil, screen, mesh and a high temperature resistant woven textile.

32. The fire barrier system of claim 21, wherein said material comprising the mechanical support layer is selected from the group consisting of stainless steel, aluminum, copper and high temperature resistant woven textiles.

33. The fire barrier system of claim 21, wherein said intumescent sheet contains intumescent material selected from the group consisting of unexpanded vermiculite, hydrobiotite, water-swelling tetrasilicic fluorine mica, expandable graphite and mixtures thereof.

34. The fire resistant barrier system of claim 21, wherein said intumescent sheet layer comprises a blend of fibers, wherein said fibers are selected from the group consisting of refractory ceramic fibers and high temperature resistant glass fibers; unexpanded vermiculite; and an organic binder.

35. The fire resistant barrier system of claim 34, wherein said intumescent sheet layer comprises a mat containing about 30 to about 45 weight percent refractory ceramic fibers, about 45 to about 60 weight percent unexpanded vermiculite, and about 5 to about 10 weight percent organic binder.

36. The fire resistant barrier system of claim 34, wherein the refractory ceramic fibers are selected from the group consisting of alumina-silica fibers, polycrystalline mullite fibers and glass fibers.

37. The fire resistant barrier system of claim 34, wherein the organic binder is an acrylate latex binder.

38. The fire resistant barrier system of claim 21, wherein said first mechanical support layer, said second layer and said at least one layer of intumescent sheet material are locally bonded together by at least one of a bonding means selected from the group consisting of tape, tacks, rivets, stitches, staples and adhesives.

39. The fire resistant barrier system of claim 38, wherein the adhesive is selected from the group consisting of pressure sensitive rubber adhesive, double adhesive coated films, hot melt rubber adhesive, hot melt glue and sprayable rubber cement.

40. The fire resistant barrier system of claim 21, wherein said barrier is adapted to be attached to a building structure with retainer angle brackets.

41. The fire resistant barrier system of claim 40, wherein the materials comprising said retainer angle brackets are selected from the group consisting of galvanized steel, stainless steel and aluminum.

42. The fire resistant barrier system of claim 21, wherein said system further comprises an expansion joint cover plate providing a bridge across an expansion joint.

43. A method for installing an architectural expansion joint fire barrier comprising:

providing a fire resistant barrier comprising a plurality of fire resistant material layers comprising a first mechanical support layer material having a first and second major surface; a second layer having a first and second major surface, wherein said second layer provides protection and mechanical support for the fire barrier; and at least one layer of intumescent sheet having a first and second major surface, wherein said at least one layer of intumescent is disposed between said first mechanical support layer and said second layer; wherein said first mechanical, said second, and said intumescent sheet layers are locally bonded together only substantially along a longitudinal center and substantially continuously along the length of said layers; and affixing said fire barrier to a building structure.

44. The method of claim 43, including affixing to the building structure, at least one radiation heat shield, and wherein said radiation heat shield comprises a plurality of fire resistant materials comprising at least one layer of inorganic fibrous mat material having a first and second major surface encapsulated by two separate layers of metalized, inorganic fiber reinforced polymeric material.

45. The method of claim 43, including installing said at least one radiation heat shield in the space above said fire barrier, within a dynamic building expansion joint.

46. The method of claim 43, including affixing said fire resistant barrier to the building structure with retainer angle brackets.

* * * * *